US010526743B2

(12) United States Patent
Kranjc

(10) Patent No.: US 10,526,743 B2
(45) Date of Patent: Jan. 7, 2020

(54) PRESSURE SENSOR WITH INCORPORATED AIR TRAP

(71) Applicant: ILLINOIS TOOL WORKS INC., Glenview, IL (US)

(72) Inventor: Igor Kranjc, Bovec (SI)

(73) Assignee: Illinois Tool Works Inc., Glenview, IL (US)

( * ) Notice: Subject to any disclaimer, the term of this patent is extended or adjusted under 35 U.S.C. 154(b) by 481 days.

(21) Appl. No.: 15/303,327

(22) PCT Filed: Jan. 22, 2015

(86) PCT No.: PCT/US2015/012402
§ 371 (c)(1),
(2) Date: Oct. 11, 2016

(87) PCT Pub. No.: WO2015/160408
PCT Pub. Date: Oct. 22, 2015

(65) Prior Publication Data

US 2017/0030005 A1 Feb. 2, 2017

(30) Foreign Application Priority Data

Apr. 14, 2014 (IT) ..... TO2014A0315

(51) Int. Cl.
*D06F 39/08* (2006.01)

(52) U.S. Cl.
CPC ..... *D06F 39/087* (2013.01)

(58) Field of Classification Search
CPC ..... D06F 39/087; D06F 39/003; D06F 2202/085; A47L 15/4244
(Continued)

(56) References Cited

U.S. PATENT DOCUMENTS

2008/0264111 A1 10/2008 Giordano
2014/0096567 A1* 4/2014 Da Pont ..... D06F 37/203 68/12.05

FOREIGN PATENT DOCUMENTS

CN 102954854 A 3/2013
EP 1934392 A1 6/2008
(Continued)

OTHER PUBLICATIONS

ISR and WO for PCT/US2015/012402 dated Mar. 26, 2015.
Search Report for Italian Application No. TO2014A000315 dated Sep. 1, 2014.

*Primary Examiner* — David G Cormier
*Assistant Examiner* — Thomas Bucci
(74) *Attorney, Agent, or Firm* — Boyle Fredrickson, S.C.

(57) ABSTRACT

Pressure sensor for measuring the level of a liquid in an appliance such as a washing machine, a dishwasher or the like, including a casing having a cavity, a deformable membrane having an outer edge fixed to the casing so as to divide the cavity of the casing in a first chamber and in a second chamber, and in wherein the membrane is susceptible to deformation as a function of the pressure difference in said chambers, and a detector device located in the first chamber and adapted to provide an electrical signal indicative of the deformation of the membrane, wherein the housing incorporates an air trap including a cup surrounding said second chamber, a tubular portion intended to be connected directly to a tank adapted to contain a liquid, and a barrier forming a siphon between said tubular portion and said second chamber.

5 Claims, 5 Drawing Sheets

(58) Field of Classification Search
USPC ..... 68/12.05, 12.21, 212; 73/722, 715, 728, 73/290 R, 714
See application file for complete search history.

(56) References Cited

FOREIGN PATENT DOCUMENTS

| | | | | | |
|---|---|---|---|---|---|
| EP | 1934392 | B1 | | 7/2009 | |
| FR | 2241062 | A1 | | 3/1975 | |
| GB | 1468870 | A | * | 3/1977 | ..... A47L 15/42 |
| GB | 1468870 | A | | 3/1977 | |
| JP | 6324990 | A | | 2/1988 | |
| JP | 05212192 | A | | 8/1993 | |
| JP | 0768083 | A | | 3/1995 | |
| JP | 5061304 | B2 | | 10/2012 | |
| WO | 2007034292 | A1 | | 3/2007 | |
| WO | 2014048948 | A1 | | 4/2014 | |

* cited by examiner

PRESSURE SENSOR WITH INCORPORATED AIR TRAP

RELATED APPLICATIONS

The present application is a National Phase of International Application Number PCT/US2015/012402, filed Jan. 22, 2015, and claims priority to Italian Application Number TO2014A000315, filed Apr. 14, 2014.

TECHNICAL FIELD

The present invention relates to a pressure sensor for measuring the level of a liquid in a household appliance such as a washing machine, a dishwasher or similar.

STATE OF THE ART

Typically, a pressure sensor for measuring the level of a liquid in an appliance comprises a hollow casing and a deformable membrane housed within the casing and having an outer edge fixed to the casing so as to divide the cavity of the housing into two chambers. In the first chamber is housed an electromagnetic detecting device adapted to detect the deformation of the membrane with respect to a state of rest. The second chamber is connected to a tank containing a liquid through an air trap. An example of a known pressure sensor is described in EP-A-1934392.

In standard washing machines the air trap is part of the machine. The purpose of the air trap is to trap a volume of air when the water level rises at the beginning of a wash cycle. The air trap prevents a direct contact of the liquid with the pressure sensor. In the known solutions, the air trap is a tubular element separated from the pressure sensor, having a first end connected to the tank containing the liquid and a second end connected to the second chamber of the sensor. The liquid contained within the tank compresses the volume of air trapped within the air trap. The membrane of the pressure sensor is deformed as a function of the air pressure inside the air trap.

There are also some appliances, such as dishwashers, in which there is not enough space to integrate an air trap with standard dimensions. In these applications, the water comes into direct contact with the membrane of the pressure sensor. This can cause fouling and deposits of detergents on the membrane with the consequence of leakage, measurement errors, etc.

OBJECT AND SUMMARY

The object of the present invention is to provide a pressure sensor which eliminates some components of the known household appliances, and thus reduce the cost, while avoiding a direct contact of the liquid with the membrane of the pressure sensor.

According to the present invention, this object is achieved by a pressure sensor having the characteristics forming the subject of claim 1.

The claims form an integral part of the teaching given in relation to the invention.

BRIEF DESCRIPTION OF THE DRAWINGS

The characteristics and advantages of the present invention will become clear in the course of the detailed description which follows, with reference to the attached drawings, given purely by way of non-limiting example, in which.

DETAILED DESCRIPTION

Figure 1:
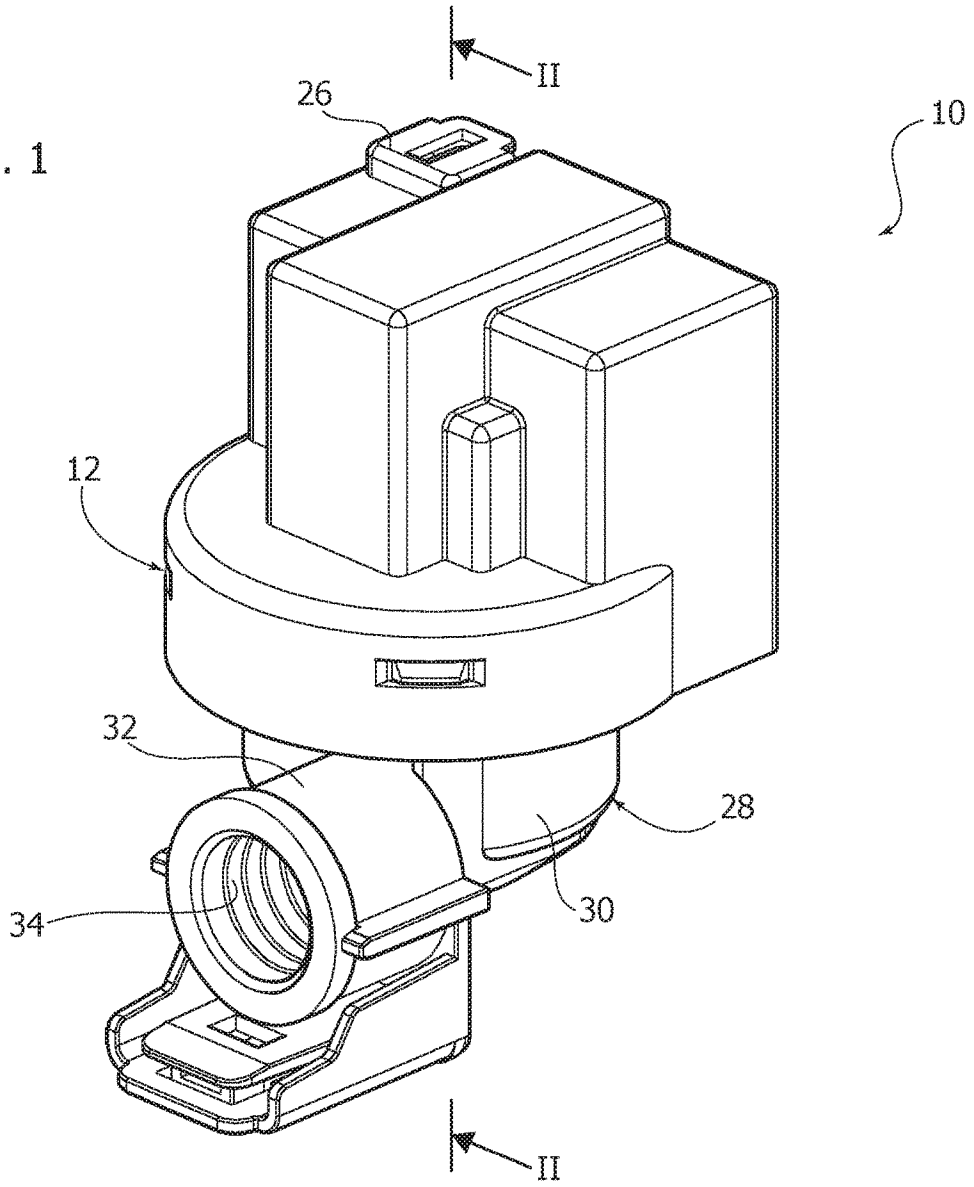
FIG. 1 is a perspective view of a pressure sensor according to the present invention.
Figure 2:
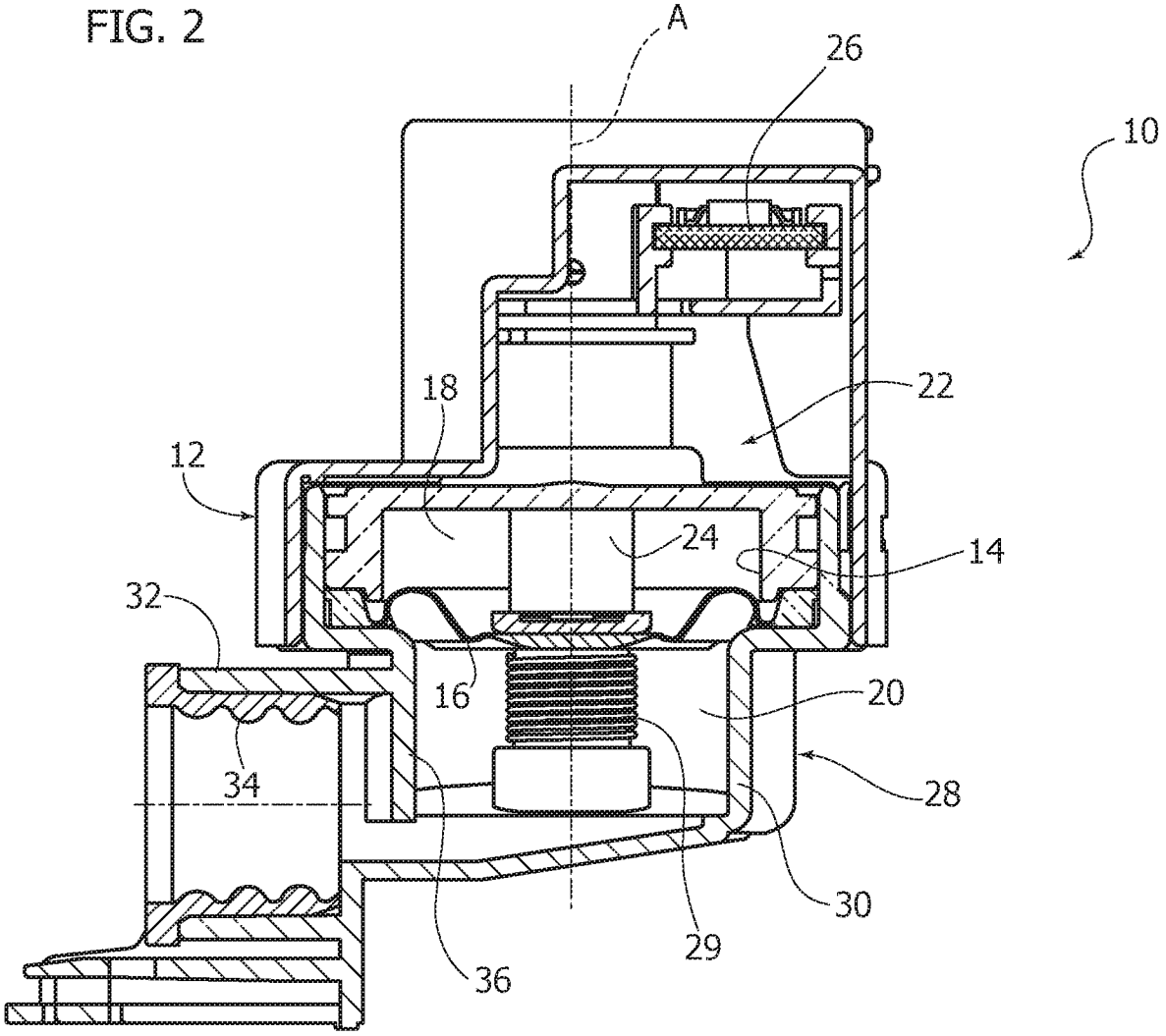
FIG. 2 is a cross-section along the line II-II of FIG. 1, and FIGS. 3, 4 and 5 are cross-sections showing the operation of the sensor according to the present invention.

With reference to FIGS. 1 and 2, reference 10 designates a pressure sensor for household appliances such as washing machines, dishwashers and the like. The pressure sensor 10 comprises a casing 12 of plastic material having a cavity 14. In the cavity 14 is fitted a membrane 16 having an outer edge fixed to the casing 12. The membrane 16 divides the cavity 14 of the casing 12 into an upper or first chamber 18 and a lower or second chamber 20. The membrane 16 is susceptible to deformation as a function of the difference of pressure in the first and second chambers 18, 20.

In the upper or first chamber 18 is housed a detector device 22 adapted to provide an electrical signal indicative of the deformation of the membrane 16. The detector device 22 may for example be an electromagnetic device including a magnetic core 24 movable along a vertical axis A and having the lower end in contact with the membrane 16. The change of position of the magnetic core 24 varies the impedance of a coil. An electrical connector 26 provides an electrical signal whose value is indicative of the deformation of the membrane 16, and therefore of the air pressure in the second chamber 20. In the second chamber 20 can be housed an elastic element 29 that counteracts the weight of the magnetic core 24.

The operation of the pressure sensor and the detector device 22 are known per se and described for example in document EP-A-1934392.

The pressure sensor 10 according to the present invention includes an air trap 28 incorporated in the casing 12. The air trap 28 is formed in the lower part of the casing 12 and includes a cup 30 which surrounds the second chamber 20. The air trap 28 comprises a tubular portion 32 in one piece with the cup 30. The tubular portion 32 has an axis orthogonal to the vertical axis A. Inside the tubular portion 32 is disposed a tubular seal or gasket 34. The inner end of the tubular portion 32 communicates with the second chamber 20.

The air trap 28 includes a barrier 36 formed by a wail that obstructs in part the internal opening of the tubular portion 32. The barrier 36 has a lower end which is at a small distance from the bottom wall of the cup 30. The barrier 36 forms a siphon between the tubular portion 32 and the second chamber 20, so that the volume of air contained in the air trap 28 remains trapped in the second chamber 20 when the tubular portion 32 is filled with liquid.

Figure 3:
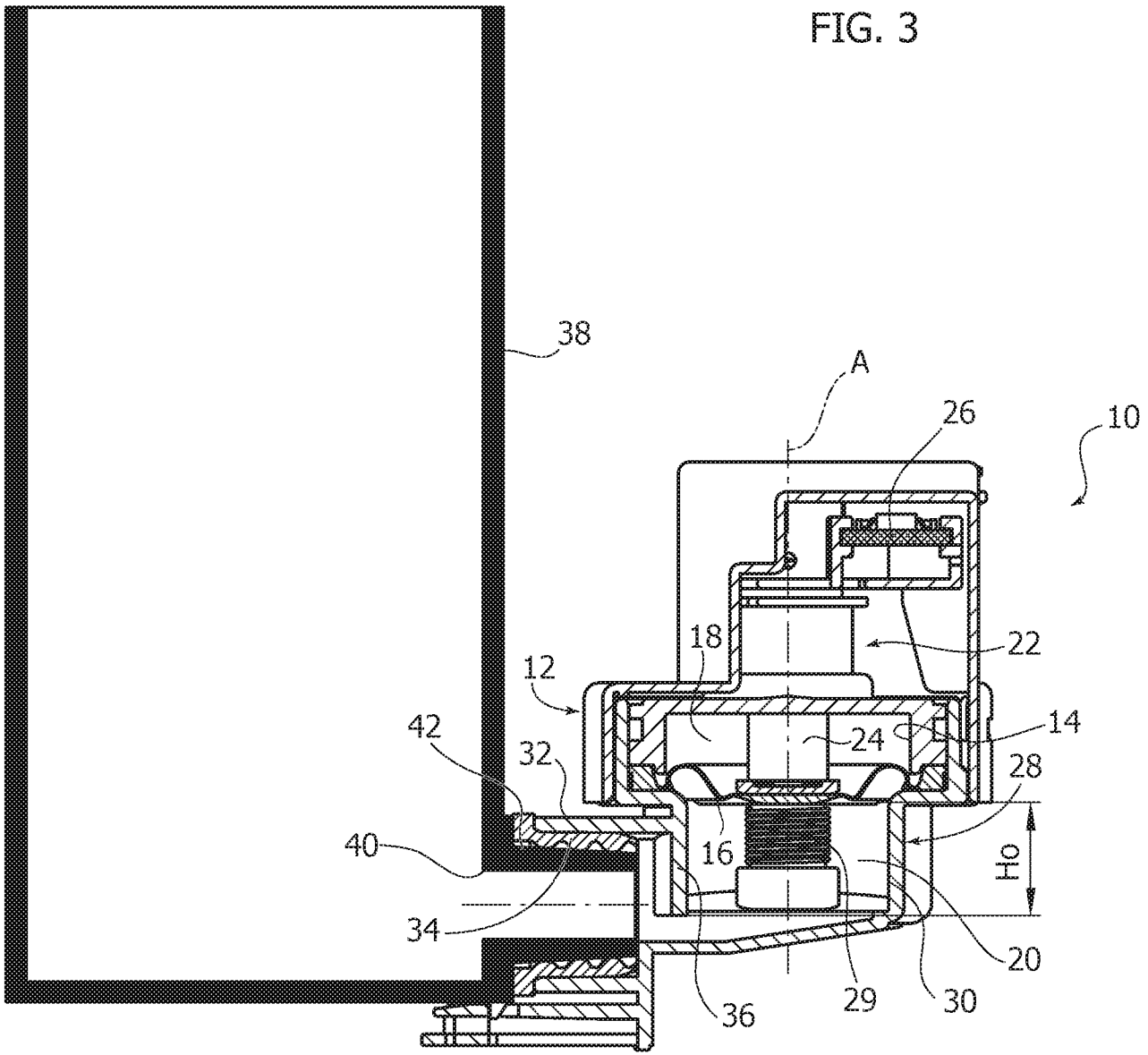
Figure 4:
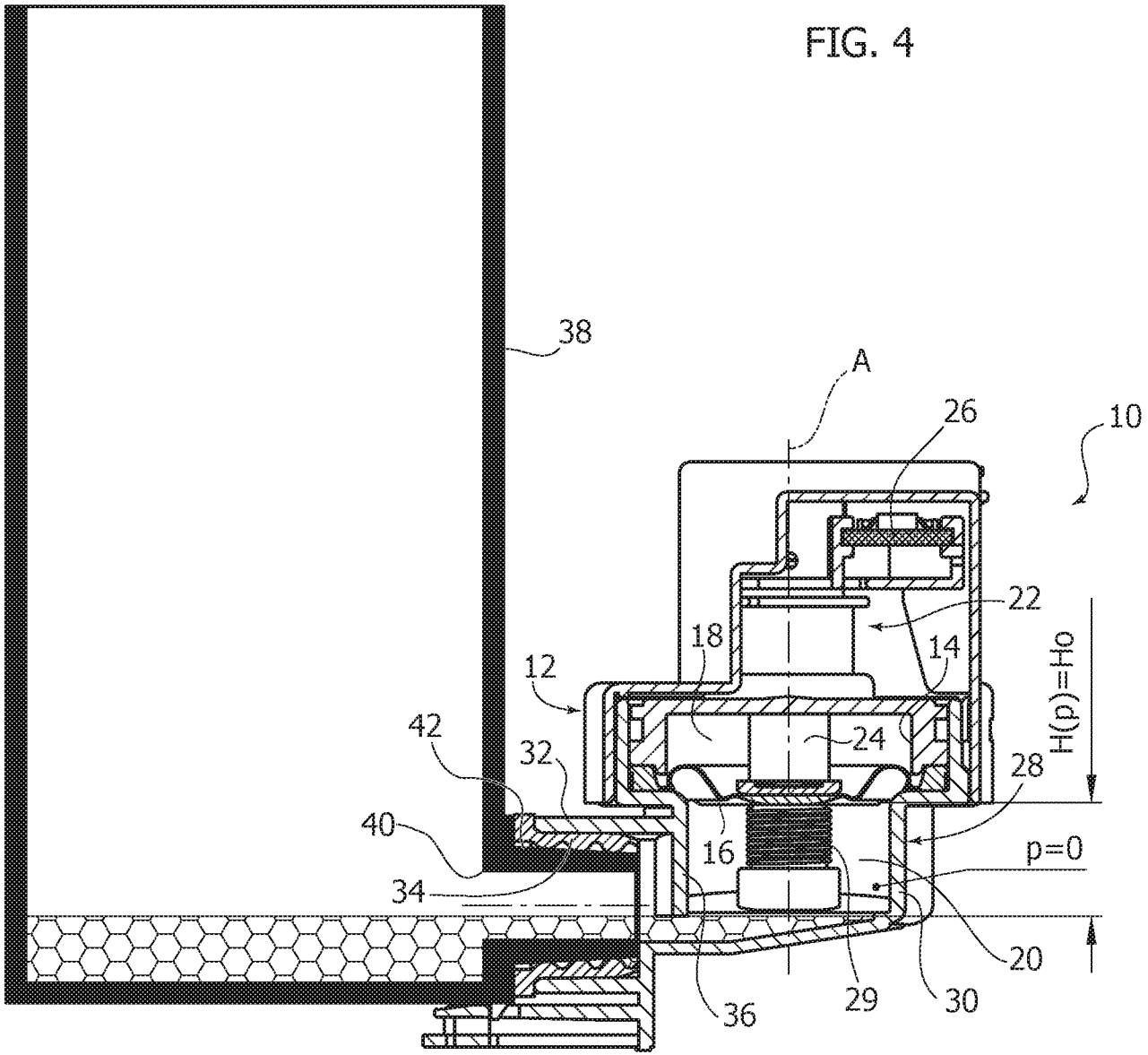

FIGS. 3, 4 and. 5 show the operation of the pressure sensor 10. The pressure sensor 10 is intended to be connected directly to a tank 38, without the interposition of a separate component which performs the function of air trap. The tank 38 has an opening 40 at its bottom wall. In correspondence with the opening 40 the tank 38 has a tubular extension 42 which is inserted into the tubular portion. 32 of the pressure sensor 10. The tubular seal or gasket 34 acts on the outer surface of the tubular extension 42 to ensure a liquid-tight connection between the sensor 10 and the tank 38.

In FIG. 3 the tank 38 is empty. The size Ho indicates the height of the volume of air contained in the second chamber 20 of the pressure sensor 10.

FIG. 4 shows the condition in which the liquid level in the tank 38 is in line with the lower edge of the barrier 36. In this condition the pressure p in the second chamber 20 is equal to the atmospheric pressure. The height H(p) indicates the height of the volume of air trapped in the air trap 28.

Figure 5:
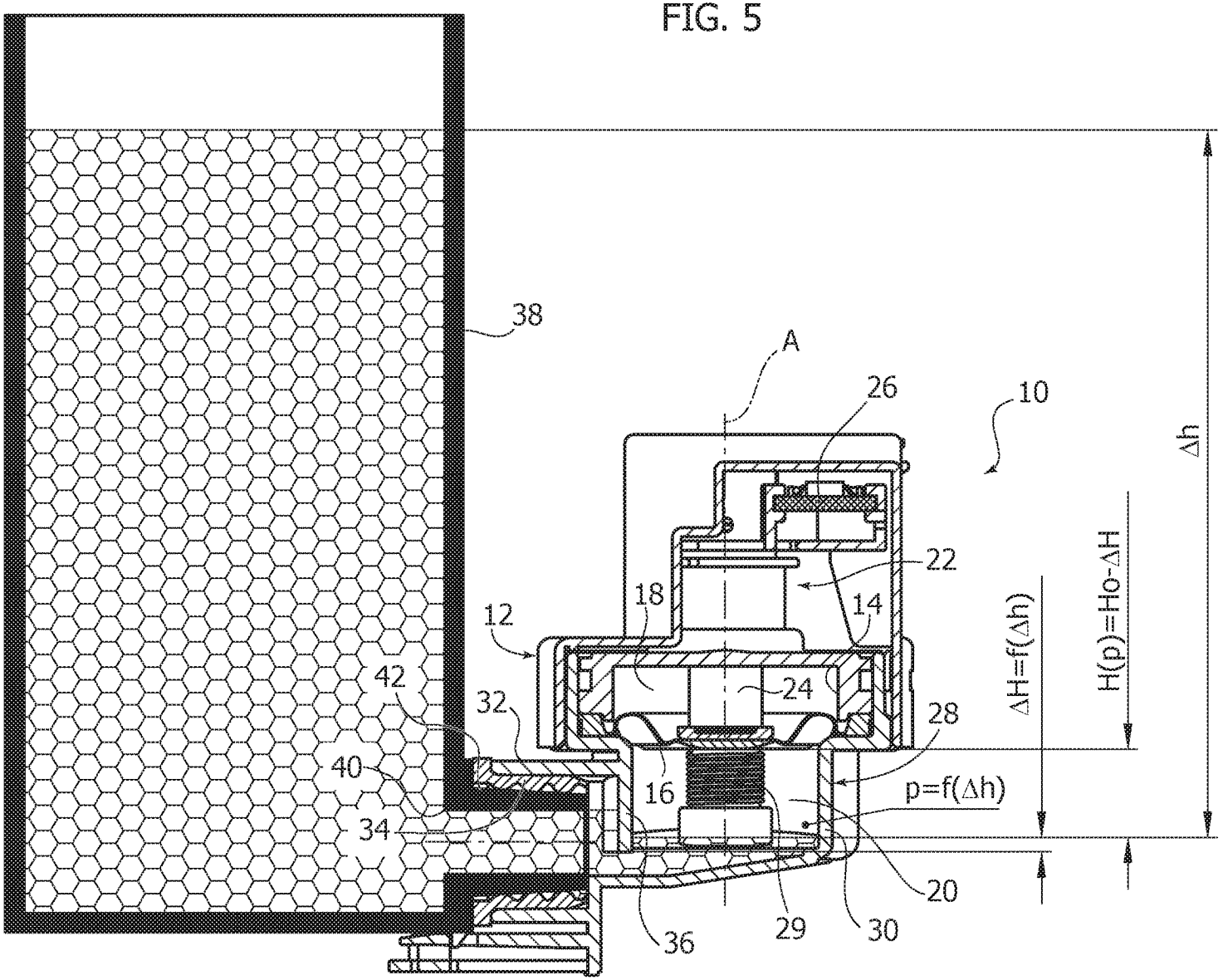

FIG. 5 shows the tank 38 containing the maximum level of liquid, indicated with Ah. In this condition, the air trapped in the second chamber 20 is pressurized to a pressure $p=f(\Delta h)$. The value of the air pressure in the second chamber 20 is directly related to the height of the liquid $\Delta h$. The height of the liquid within the second chamber 20 is indicated with H(p). The increase in height of the liquid contained in the second chamber 20 with respect to the condition of FIG. 4 is indicated $\Delta H=f(\Delta h)$.

The volume of the second chamber 20, the geometry and size of the cup 30 and of the barrier 36 are determined so that with the maximum level of liquid contained in the tank 38 $\Delta h$ the liquid level in the second chamber 20 $\Delta H$ never reaches the membrane 16. It is then prevented a direct contact of the liquid with the membrane 16 in any operating condition.

The pressure sensor with integrated air trap allows to reduce the number of components compared to the traditional structures, as it is no longer necessary to provide a separate air trap for the connection of the pressure sensor. Consequently, costs and the number of parts to assemble are reduced.

The integration of the air trap in the pressure sensor according to the present invention avoids a direct contact of the liquid with the membrane and will considerably reduce the risks of damage and leakage of the sensor and the errors of the sensor response.

Of course, without prejudice to the principle of the invention, the details of construction and the embodiments may vary widely with respect to those described and illustrated without departing from the scope of the invention as defined by the claims that follow.

The invention claimed is:

1. A pressure sensor for measuring the level of a liquid in an appliance, the pressure sensor comprising:

a casing having a cavity, deformable membrane having an outer edge fixed to the casing so as to divide the cavity of the casing in a first chamber and in a second chamber, and wherein the membrane is susceptible to deformation as a function of a pressure difference between the chambers, and a detector device located in the first chamber and adapted to provide an electrical signal indicative of the deformation of the membrane, wherein the casing incorporates an air trap including:

a cup surrounding the second chamber and defining a cup height that corresponds to a height of the second chamber, a tubular portion having an outer end configured to be connected directly to a tank adapted to contain a liquid, an inner end configured to direct the liquid toward the second chamber, and a tubular passage extending between the outer and inner ends and defining a tubular passage height that overlaps a portion of the cup height, and a barrier arranged between the tubular portion inner end and the second chamber and having a barrier height that is less than each of the cup height and the tubular passage height, with the barrier forming a constriction of the inner end of the tubular portion and a siphon between the tubular portion and the second chamber, in which the air trap is dimensioned so that a volume of air that remains trapped in the second chamber when the tubular passage is full of liquid prevents a direct contact between the liquid and the membrane.

2. The pressure sensor of claim 1, wherein the barrier is formed by a wall that defines a portion of the cup that obstructs in part the inner end of the tubular portion.

3. The pressure sensor of claim 2, wherein the barrier has a lower edge that is spaced from a lower wall of the cup.

4. The pressure sensor of claim 1, wherein the air trap further comprises a seal disposed on an inner wall of the tubular portion.

5. The pressure sensor of claim 1, wherein:

the cup defines a cup width that corresponds to a width of the second chamber;

the barrier defines a barrier passage that has a barrier passage height and extends between the inner end of the tubular portion and the second chamber, and wherein each of the cup width and the tubular passage height has a magnitude that is as least twice a magnitude of the barrier passage height.

* * * * *